US010092059B2

(12) United States Patent
Legg et al.

(10) Patent No.: US 10,092,059 B2
(45) **Date of Patent: *Oct. 9, 2018**

(54) SHOE PAIR WITH POSITION INDICATOR ASSEMBLY

(71) Applicant: PairMe Products, LLC, Lambertville, NJ (US)

(72) Inventors: Lindsey Legg, Lambertville, NJ (US); Alyssa Soto, Stockton, NJ (US); Earl Wilkins, Lambertville, NJ (US)

(73) Assignee: PairMe Products, LLC, Lambertville, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/856,447

(22) Filed: Dec. 28, 2017

(65) Prior Publication Data

US 2018/0116328 A1 May 3, 2018

Related U.S. Application Data

(63) Continuation of application No. 15/028,834, filed as application No. PCT/US2015/023342 on Mar. 30, 2015, now Pat. No. 9,867,418.

(60) Provisional application No. 62/071,936, filed on Mar. 31, 2014.

(51) Int. Cl.
*G08B 21/00* (2006.01)
*A43B 3/00* (2006.01)

(52) U.S. Cl.
CPC ..... *A43B 3/0021* (2013.01); *A43B 3/001* (2013.01); *A43B 3/0005* (2013.01); *A43B 3/0094* (2013.01)

(58) Field of Classification Search
None
See application file for complete search history.

(56) References Cited

U.S. PATENT DOCUMENTS

| | | | | |
|---|---|---|---|---|
| 3,258,858 A | | 7/1966 | Carife, Jr. | |
| 3,946,505 A | | 3/1976 | Dana, III | |
| 5,240,418 A | | 8/1993 | Silverman | |
| 5,244,233 A | * | 9/1993 | McCraney | A43B 1/0036 132/200 |
| 5,269,690 A | * | 12/1993 | Zigon | A43B 3/0078 36/112 |

(Continued)

FOREIGN PATENT DOCUMENTS

| | | |
|---|---|---|
| AU | 2010100413 | 6/2010 |
| CA | 1193436 | 9/1985 |

(Continued)

*Primary Examiner* — Curtis King
(74) *Attorney, Agent, or Firm* — Diederiks & Whitelaw, PLC

(57) ABSTRACT

A position indicator assembly, including first and second positioning units, is attached to a pair of shoes in positions which are spaced when the shoes are aligned together. Each positioning unit includes a first proximity switch element, at least one indicator, a battery and a second proximity switch element. The battery is electrically connected to the indicator when the first proximity switch element of one of the first and second position units is arranged a predetermined, spaced distance from the second proximity switch element of the other of the first and second positioning units in order to provide a visual and/or audible indication to a wearer that the pair of shoes are on the correct feet.

20 Claims, 5 Drawing Sheets

(56) References Cited

U.S. PATENT DOCUMENTS

| | | | | |
|---|---|---|---|---|
| 5,313,187 | A | 5/1994 | Choi et al. | |
| 5,371,662 | A | 12/1994 | Shen-Ko | |
| 5,483,759 | A | 1/1996 | Silverman | |
| D367,553 | S | 3/1996 | Delfel et al. | |
| 5,500,635 | A | 3/1996 | Mott | |
| 5,502,903 | A | 4/1996 | Barker | |
| 5,577,828 | A | 11/1996 | Nadel et al. | |
| 5,586,888 | A * | 12/1996 | Webb | A43B 3/0078 36/112 |
| 5,732,486 | A | 3/1998 | Rapisarda | |
| 5,857,273 | A | 1/1999 | Rapisarda | |
| 5,903,103 | A | 5/1999 | Garner | |
| 5,914,659 | A | 6/1999 | Herman et al. | |
| 6,030,089 | A | 2/2000 | Parker et al. | |
| 6,764,193 | B1 | 7/2004 | Wei | |
| 6,908,206 | B1 | 6/2005 | Pinciaro | |
| 6,991,342 | B2 | 1/2006 | Gonet | |
| 7,071,828 | B2 | 7/2006 | Wong | |
| 7,178,929 | B2 | 2/2007 | Guzman | |
| 7,207,688 | B2 | 4/2007 | Yuen et al. | |
| 7,228,649 | B2 | 6/2007 | Elliott | |
| 7,254,910 | B2 | 8/2007 | Guzman | |
| 7,255,468 | B2 | 8/2007 | Capriola | |
| 7,481,010 | B2 | 1/2009 | Chen | |
| 7,494,237 | B1 | 2/2009 | Cheung | |
| 7,497,037 | B2 | 3/2009 | Vick et al. | |
| 7,579,946 | B2 | 8/2009 | Case, Jr. | |
| 7,717,583 | B2 | 5/2010 | Tuan | |
| 7,762,680 | B1 | 7/2010 | Miller et al. | |
| 7,895,774 | B2 | 3/2011 | Pawsey | |
| 8,056,268 | B2 | 11/2011 | Dibenedetto et al. | |
| 8,154,403 | B1 | 4/2012 | Pienkos | |
| 8,281,440 | B2 | 10/2012 | Cheung | |
| 8,469,535 | B2 | 6/2013 | Guzman | |
| 9,597,497 | B2 | 3/2017 | Swain et al. | |
| 2002/0020082 | A1 | 2/2002 | James | |
| 2005/0239567 | A1 * | 10/2005 | Elliott | A43B 1/0036 473/207 |
| 2006/0013081 | A1 | 1/2006 | Williams | |
| 2006/0026869 | A1 * | 2/2006 | Covington | A43B 3/0005 36/112 |
| 2007/0123806 | A1 * | 5/2007 | Bouvier | A43D 1/02 600/595 |
| 2007/0245598 | A1 | 10/2007 | Pawsey | |
| 2008/0258921 | A1 | 10/2008 | Woo | |
| 2009/0278707 | A1 | 11/2009 | Biggins | |
| 2010/0039239 | A1 | 2/2010 | Ibetoh | |
| 2011/0192057 | A1 | 8/2011 | Matesan | |
| 2012/0124867 | A1 * | 5/2012 | Heinrich | A43B 1/0054 36/136 |
| 2013/0008058 | A1 * | 1/2013 | Jasmine | A43B 23/24 36/136 |
| 2013/0167709 | A1 * | 7/2013 | Gibson | G10H 3/146 84/746 |
| 2013/0337424 | A1 | 12/2013 | Selix | |
| 2014/0266570 | A1 | 9/2014 | Sharma | |
| 2014/0266571 | A1 * | 9/2014 | Sharma | G09B 21/003 340/4.12 |
| 2015/0040437 | A1 | 2/2015 | Ibetoh | |
| 2015/0282552 | A1 | 10/2015 | Coe | |
| 2016/0015115 | A1 | 1/2016 | Hammond | |
| 2016/0165965 | A1 | 6/2016 | Ellis | |

FOREIGN PATENT DOCUMENTS

| | | |
|---|---|---|
| CN | 201691146 | 1/2011 |
| EP | 0522882 | 1/1993 |
| KR | 200429885 | 11/2006 |
| KR | 20110030020 | 3/2011 |
| KR | 2012-0130489 | 12/2012 |
| WO | 2013/061038 | 5/2013 |

* cited by examiner

SHOE PAIR WITH POSITION INDICATOR ASSEMBLY

CROSS-REFERENCE TO RELATED APPLICATIONS

The present application represents a continuation of U.S. patent application Ser. No. 15/028,834, filed Apr. 12, 2016, which represents a National Stage Application of PCT/US2015/023342 entitled "Shoe Pair with Position Indicator Assembly" filed Mar. 30, 2015, which claims priority to U.S. Provisional Patent Application Ser. No. 62/071,936 filed Mar. 31, 2014 and entitled "LED Shoe Lite Emblem."

BACKGROUND OF THE INVENTION

The present invention pertains to the art of footwear and, more particularly, to providing a pair of shoes with a position indicator assembly for signaling when the pair of shoes are properly aligned or matched for use.

It is not uncommon for young children to either incorrectly match shoes or, even if a pair of shoes is correctly matched, place the shoes on the wrong feet. That is, for visual or other reasons, young children, and even occasionally some adults, can have difficulty correctly identifying the right and left shoes of a pair of shoes, resulting in a right shoe being placed on a left foot and a left shoe being placed on a right foot. Often, it is another person, such as a mother, father, friend or even a stranger, who points out the error of the individual. Although certainly helpful in correcting the mistake, the knowledge can actually be embarrassing.

To avoid this situation, it has been proposed in the art to provide a pair of shoes with additional structure to verify to an individual that a particular pair of shoes are properly aligned. For instance, it has been proposed to place matching, partial emblems on right and left shoe pairs wherein, when the pair of shoes is properly aligned, the partial emblems combine to form a complete emblem. For example, U.S. Pat. No. 5,586,888 discloses providing partial images in the form of mirror image half-hearts or half-stars on the toe portions of right and left shoes such that, when the two shoes are correctly aligned and placed in contact with one another at the toe portions, a complete heart or star is illustrated, thereby signaling to the wearer that the shoes are properly positioned for use. In another exemplary arrangement represented by U.S. Pat. No. 7,246,455, the toe portions of a matching pair of shoes are provided with part of an electrical switch such that, when the toe portions abut each other, the switch is engaged and closed to complete an electrical circuit and present an audible or visual indication to the individual that the shoes are properly aligned.

Although these known arrangements attempt to solve the issue at hand, a rather precision alignment is required in order for a suitable alignment indication to be conveyed. In particular, although the electrical embodiment is seen to be a considerable improvement over the emblem arrangement, the need to provide direct pressure to the switch can create significant functional concerns. This limitation can actually result in the individual failing to receive a signal even when the shoes are properly aligned. With this in mind, there is still seen to be a need in the art for a shoe pair with a position indicator assembly which does not require such a precision alignment of a matched right and left shoe pair and, even more specifically, can convey to the individual that a matched pair of shoes are properly aligned without requiring portions of the shoes to engage one another but rather even when the shoes are actually arranged a predetermined, spaced distance from each other.

SUMMARY OF THE INVENTION

The present invention is concerned with providing an individual with a visual or other indication when a pair of shoes are properly aligned. In essence, the pair of shoes includes first and second mirror image shoes, with each of the shoes having a shoe body including a sole portion and an upper portion, with the sole and upper portions defining at least a toe section, inner and outer instep sections and a counter section. With this arrangement, when the shoe pair is properly aligned, the inner instep sections of the first and second shoes are facing each other, the respective toe and counter sections of the first and second shoes are positioned to simultaneously abut each other, and the inner instep sections of the first and second shoes are spaced from one another. In particular accordance with the present invention, the shoe pair is provided with a position indicator assembly including first and second positioning units attached to the first and second shoes respectively. More specifically, the first and second positioning units include at least one indicator, such as an LED light, mounted on at least one of the first and second shoes, at least one battery for powering the at least one indicator, and a proximity switch electrically interposed between the at least one battery and the at least one indicator. The proximity switch includes first and second proximity switch elements provided on the first and second shoes respectively.

With this arrangement, the proximity switch is configured to be activated to electrically connect the at least one battery with the at least one indicator when the first and second proximity switch elements are arranged a predetermined, spaced distance from each other. As the proximity switch elements need not directly engage each other, the overall indicator assembly can be located in various positions on the shoes, either as attachments or integrated into the making of the shoes. For instance, in accordance with a preferred form of the invention, the first and second proximity switch elements are located at the inner instep portions of first and second shoes, respectively.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
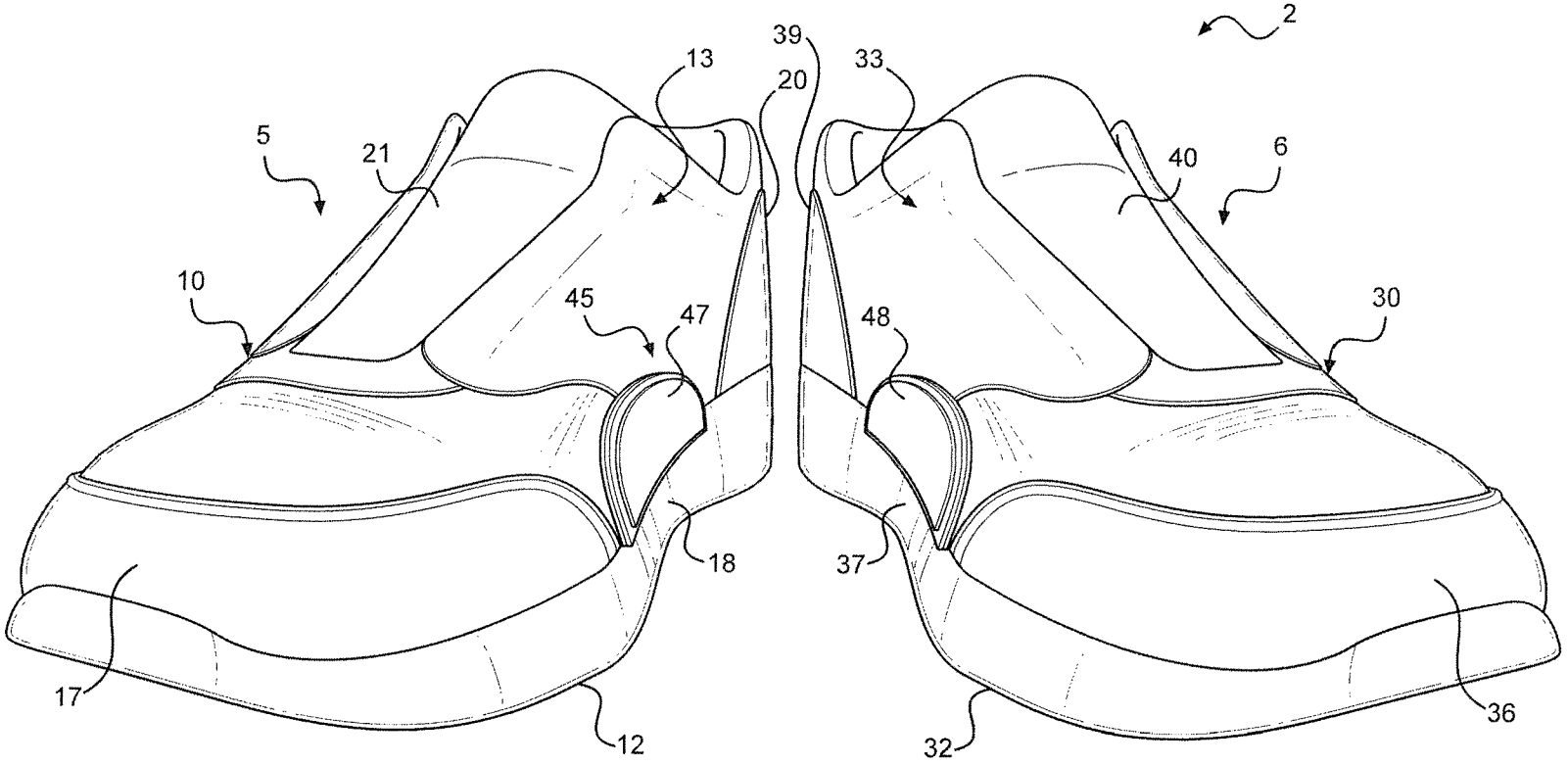
FIG. 1 is a perspective view of a pair of shoes incorporating a position indicator assembly according to the invention.

With initial reference to FIG. 1, a pair of shoes is generally indicated at 2 to include a right shoe 5 and a left shoe 6, with right and left shoes 5 and 6 being mirror images of one another as is customary. In general, right shoe 5 is defined by a shoe body 10 having a sole portion 12 and an upper portion 13. Sole and upper portions 12 and 13 define a toe section 17, an inner instep section 18, an outer instep section 19, a counter section 20 and a tongue 21. At this point, it should be noted that upper portion 13 can be tightened to retain a foot therein in various different ways, including the use of elastic material, hook-and-loop type fasteners, laces and the like, all of which are known in the art and do not form part of the present invention. Left shoe 6 is similarly constructed and includes a shoe body 30 having a sole portion 32 and an upper portion 33. In a manner directly similar to right shoe 5, left shoe 6 includes a toe section 36, an inner instep section 37, an outer instep section 38, a counter section 39 and a tongue 40.

Figure 2:
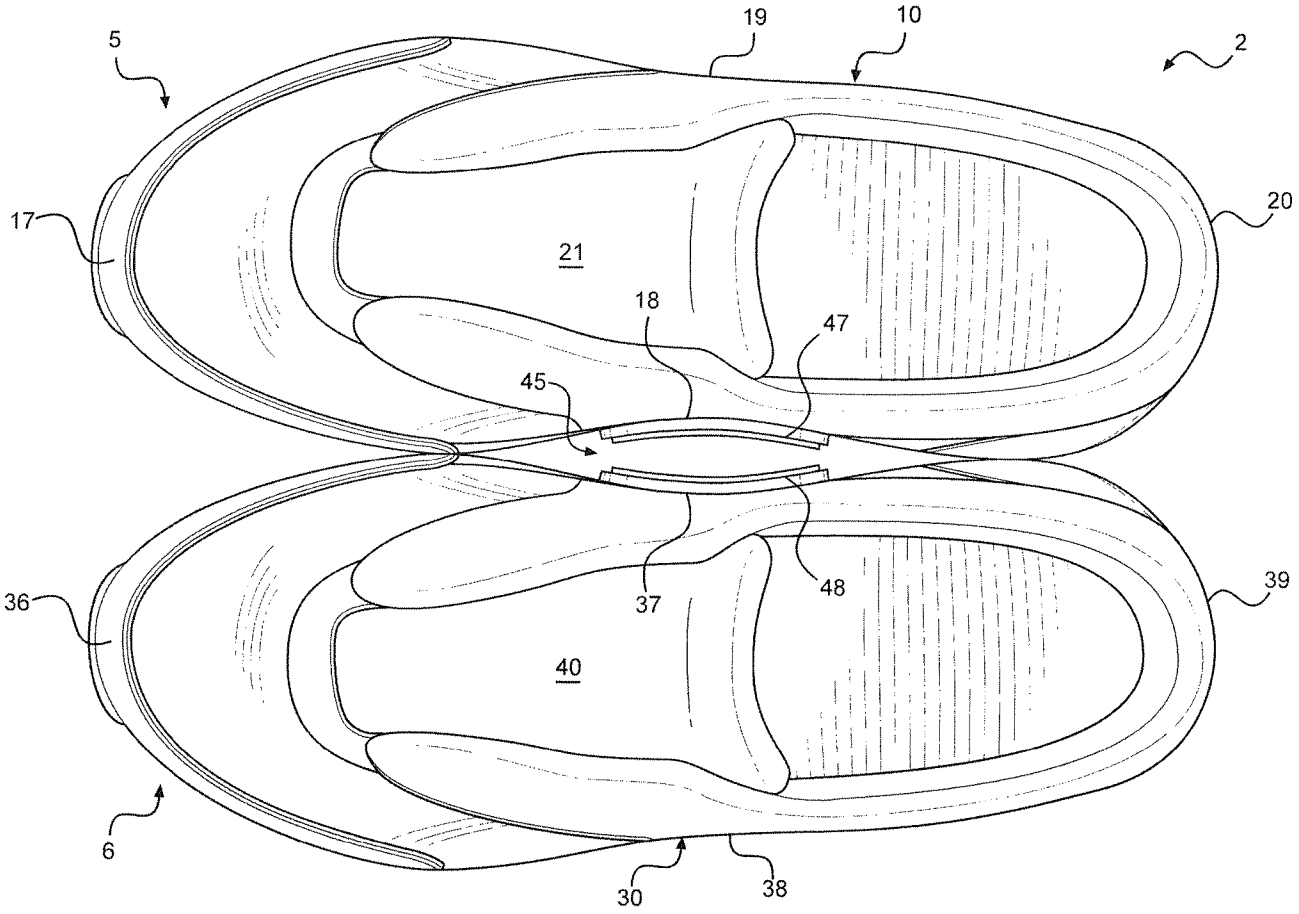
FIG. 2 is a top view of the pair of shoes of FIG. 1 arranged with engaged toe and heel regions.

Certainly, it should be recognized that the depicted pair of shoes 2 are intended to be generic both in size and style. More important in connection with the present invention is the inclusion of a position indicator assembly, generally indicated at 45, attached to the pair of shoes 2. In general, position indicator assembly 45 includes a first positioning unit 47 and a second positioning unit 48. In the embodiment depicted, first positioning unit 47 is mounted to right shoe 45 at inner instep section 18, while second positioning unit 48 is mounted to left shoe 6 and inner instep section 37. As will be detailed more fully below, each of first and second positioning units 47, 48 includes at least one indicator, a battery for powering the at least one indicator, and a proximity switch, at least a portion of which is electrically interposed between the battery and the indicator. The proximity switch is configured to be activated to electrically connect the battery with the indicator only when first and second proximity switch elements of the pair of shoes are arranged a predetermined, spaced distance from each other. With the mounting arrangement described above, when right and left shoes 5 and 6 are properly aligned, as best shown in FIG. 2, the spaced first and second positioning units 47 and 48 will be activated in order to provide a visual and/or audible indication to a wearer of the pair of shoes 2 that the shoes are on the correct feet.

Figure 3:
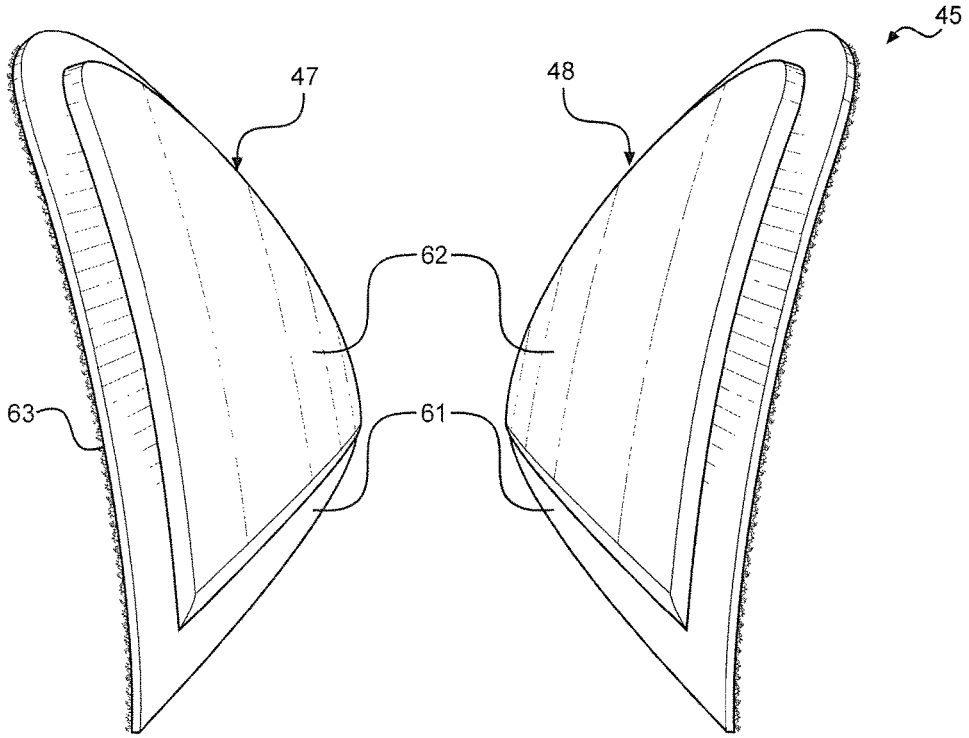
FIG. 3 illustrates an exemplary position indicator assembly constructed in accordance with the invention.
Figure 4:
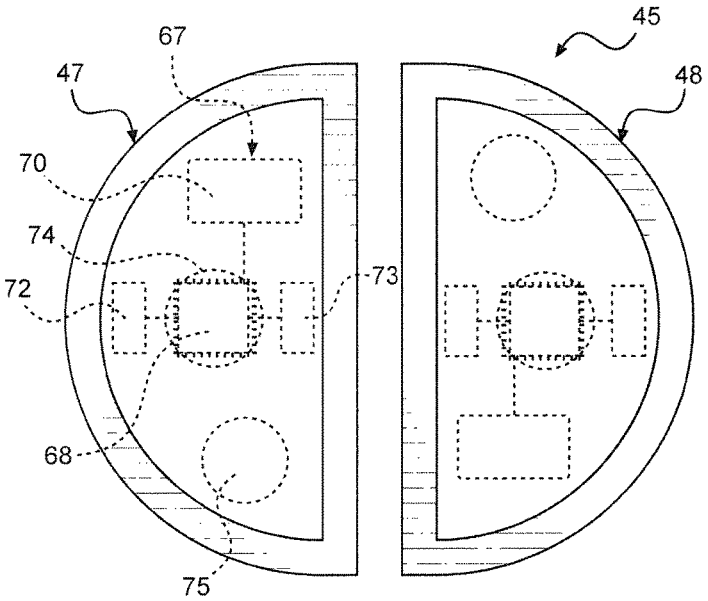
FIG. 4 is a top view of the position indicator assembly of FIG. 3, with internal structure being indicated.

In accordance with the invention, first and second positioning units 47 and 48 can take various forms. FIGS. 3 and 4 illustrate one potential construction wherein each of first and second positioning units 47, 48 includes a main body 61, a projecting outermost layer 62 and a mounting, innermost layer 63. Encased within main body 61 is an electrical circuit 67 including a programmed controller chip 68, a first proximity switch element 70, LED diodes 72 and 73, a battery 74 and a second proximity switch element 75. In accordance with the invention, each first proximity switch element 70 constitutes a sensor or receiver and each second proximity switch element 75 constitutes a transmitter. Therefore, as will become fully apparent below, the first proximity switch element 70 of the first positioning unit 47 combines with the second proximity switch element 75 of the second positioning unit 48 to establish a proximity switch, while a corresponding arrangement exists between the first proximity switch element 70 of the second positioning unit 48 and the second proximity switch element 75 of the first positioning unit 47. With this arrangement, when first proximity switch element 70 of first positioning unit 47 comes in close proximity to the second proximity switch element 75 of second positioning unit 48, battery 74 is connected to the respective LED diode 72, 73 in first positioning unit 47 such that LED diodes 72 and 73 are illuminated. In the exemplary embodiment shown in FIG. 4, the first and second positioning units 47 and 48 are identically constructed such that, at the same time that LED diodes 72 and 73 of the first positioning unit 47 are being illuminated, LED diodes 72 and 73 of second positioning unit 48 are also being illuminated. In this embodiment, outermost layer 62 is translucent such that the light from each set of LED diodes 72 and 73 will be visible to the wearer through outermost layer 62.

Important in connection with the present invention is the fact that first and second positioning units 47 and 48 do not need to engage one another and, preferably, are arranged on portions of right and left shoes 5 and 6 wherein the first and second positioning units 47 and 48 cannot engage each other during normal use of the pair of shoes 2. In the embodiment shown in FIG. 2, mounting first and second positioning units 47 and 48 at inner instep sections 18 and 37 accomplishes this function since, when right and left shoes 5 and 6 are properly aligned, toe sections 17 and 36, as well as counter sections 20 and 39 directly abut each other while inner instep sections 18 and 37 are spaced apart (again see FIG. 2). Although first and second proximity switch elements 70 and 75 can take various forms in accordance with the invention, one preferred form of the invention employs a magnetic field sensor for first proximity switch element 70 and a magnet for second proximity switch element 75. LED diodes 72 and 73 will become activated when the respective first and second proximity switch elements 70 and 75 from first and second positioning units 47 and 48 are a predetermined, spaced distance from each other, such as, for example, in the order of one-half inch (1.27 cm). Therefore, in accordance with this embodiment, the switch is operated by an applied magnetic field, such as by opening once the magnetic field on the opposite side of the shoe is detected, without any necessary physical contact. The switch then closes once the magnetic field on the opposite side of the shoe is no longer within a predetermined nominal range. In connection with this embodiment, it is also important that the second proximity switch element 75 (magnet) be spaced from the first proximity switch element 70 (sensor) on a given one of the first and second positioning units 47, 48 a distance greater than the predetermined, spaced distance referenced above (e.g., one inch or 2.54 cm) such that only the magnet on one of the first and second positioning units 47, 48 can be possibly sensed by the sensor on the other of the first and second positioning units 47, 48. Although magnetic switches represent one preferred embodiment for proximity switch elements 70, as indicated above, various other types of proximity switches could be employed, including infrared, optical, inductive and radio-type proximity switches, each of which employ pairs of first and second proximity sensor elements arranged on the different positioning units 47 and 48.

Figure 5:
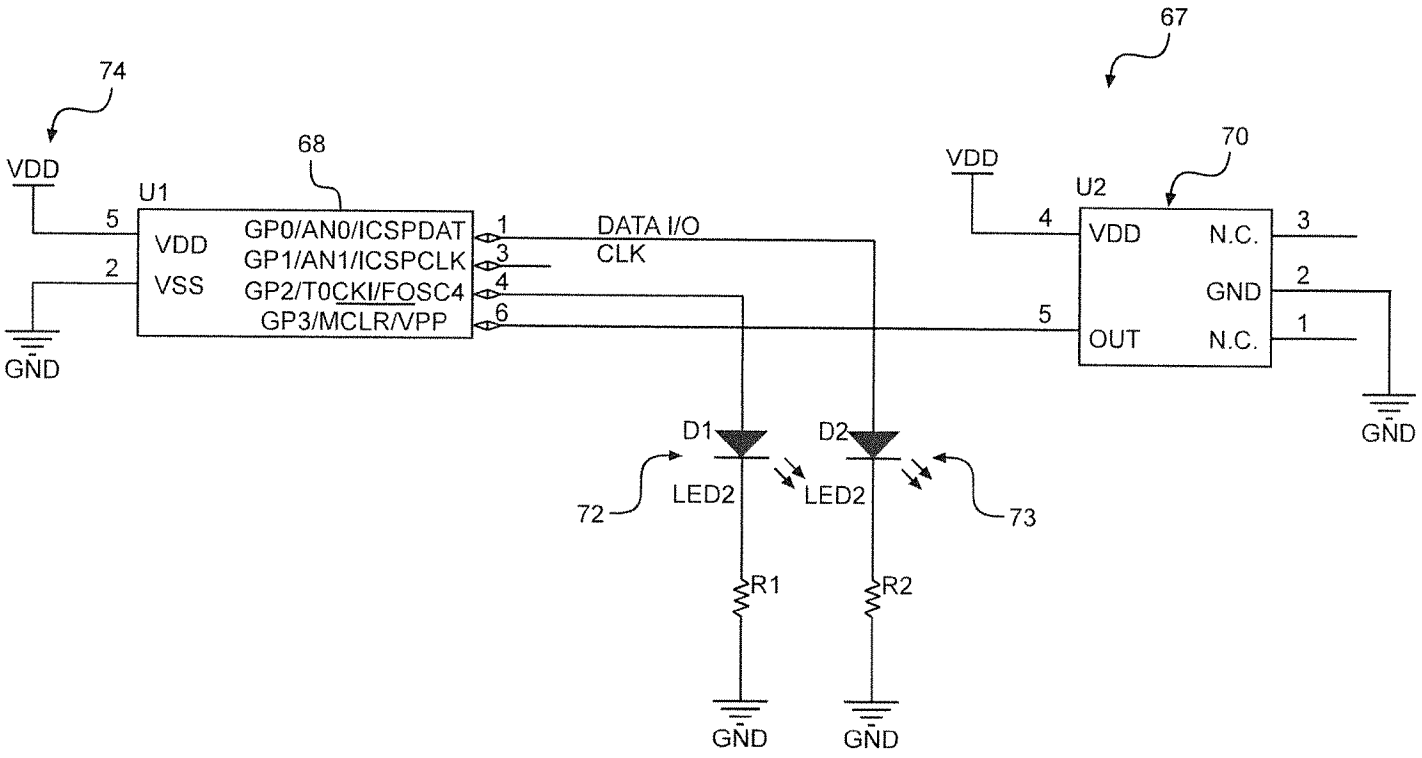
FIG. 5 depicts an exemplary circuit diagram of main components of the position indicator assembly.

For the sake of completeness, FIG. 5 depicts a potential embodiment for electric circuit 67 with a computer chip 68 being constituted by a programmable chip, such as a high performance microcontroller with 8-bit A/D, 256 (x12-Bit words) with programmable memory, 16 Bytes data memory, 6-pin OT-23 part no. PIC10F220T-I/OT available from MICROCHIP which is connected to battery 74 (e.g., BR-1225A/FAN from PANASONIC) at terminals 2 and 5, linked to LED diodes 72 and 73 (such as part XZM2ACR55W-1 from SunLED) at terminals 1 and 4 and connected to proximity switch element 70 (such as BU52011HFVCT-ND from Rohm Semiconductor) through terminal 6. Certainly, it should be recognized that there are an abundance of different, potential electrical circuit configurations and components which can be utilized in accordance with the invention. In addition, as indicated above, an audible indicator could also be employed either in place of, or in addition to, one or more of LED diodes 72 and 73. Although electric circuit 67 could even be further simplified, even avoiding the need for programmed chip 68, a programmed chip is desired in accordance with the invention to provide for additional features and controls. For instance, the use of programmed chip 68 advantageously enables a given set of proximity switch elements 70 to be paired such that only the proximity switch element 70 of a given pair of shoes 2 including right and left mirror image shoes 5 and 6 will activate a given position indicator assembly 45. In addition, programmed chip 68 also provides for a timer feature wherein the electrical connection of battery 74 to the one or more LED diodes 72, 73 is only maintained for a pre-set time period following activation. Therefore, if a user were to properly align right and left shoes 5 and 6 in a manner indicated in FIG. 2 and remained in that position, position indicator assembly 45 would only be activated for a prescribed time period, such as in the order of five seconds, and then a sleep mode would be automatically entered in order to not drain batteries 75. The sleep mode is also entered when proximity switch elements 70 are out of range, e.g., out of the range of the created magnetic field. However, once right and left shoes 5 and 6 were to become misaligned such that first and second positioning units 47 and 48 are spaced greater than the predetermined distance, such as shown in FIG. 1, and then later realigned, position indicator 45 could again be activated in the timed fashion. Furthermore, LED's 72 and 73 can be caused to blink and/or change colors.

Figure 6:
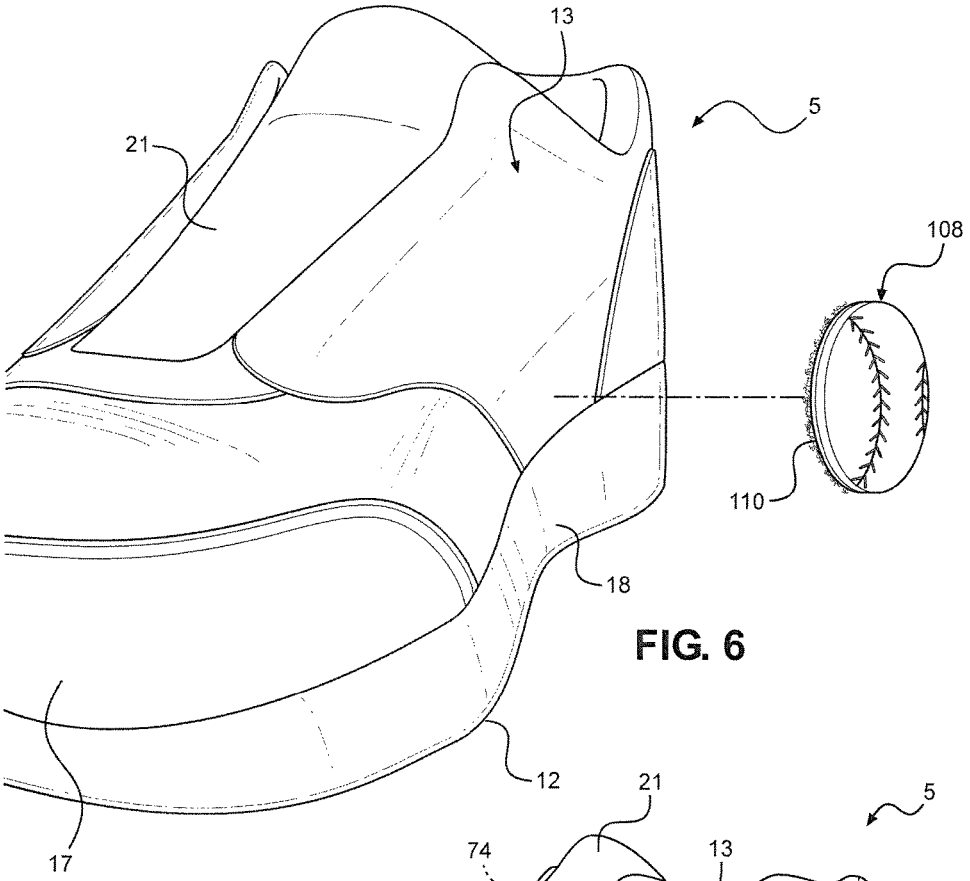
FIG. 6 is an exploded view illustrating the retrofit attachment of a position indicator of the invention to an existing shoe.
Figure 7:
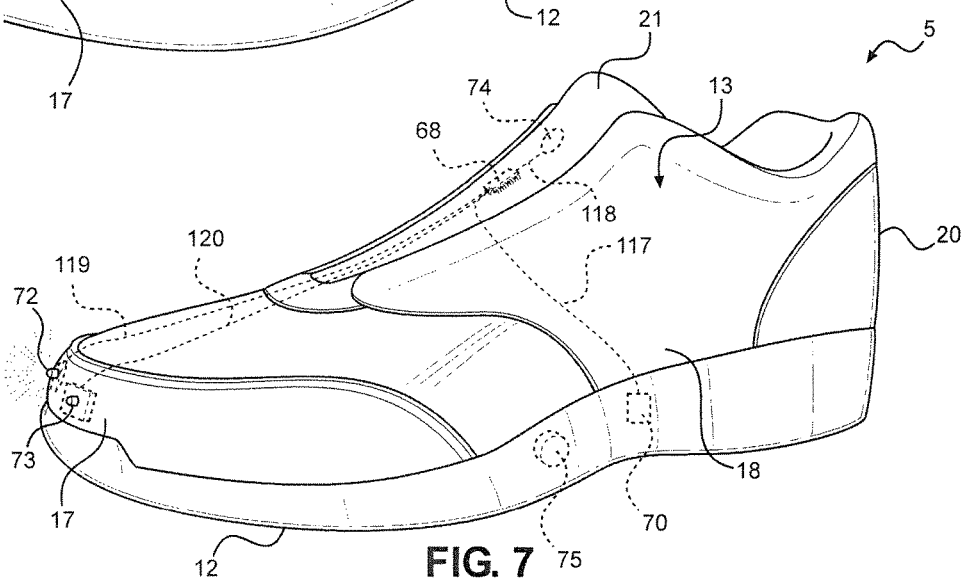
FIG. 7 is a perspective view of a shoe having a position indicator constructed in accordance with the invention shown integrated therein.

In accordance with the overall invention, first and second positioning units 47 and 48 can take various forms. In the embodiment described above, all the structure associated with each of the first and second positioning units 47, 48 is encapsulated within main body 61, such as by mounting all of the electrical structure on a common circuit board (not shown) and molding the main or indicator body 61 of an elastomeric material, e.g., silicon rubber, flexible polyurethane, soft plastic or the like (potentially with glow-in-the-dark properties), which extends completely about and encapsulates the circuit board. Certainly the shape of both main body 61 and outermost layer 62 can also take various forms, with FIG. 6 indicating this overall structure to constitute an emblem 108, which in this exemplary embodiment is reminiscent of a baseball. In this embodiment, emblem 108 is adapted to be attached to right shoe 5 at inner instep section 18 in order to retrofit right shoe 5 with first positioning unit 47. By way of example, innermost layer 63 constitutes an attachment layer defined by a felt-like material 110 (much like the furry side of VELCRO) which is adhesively secured to right shoe 5, with the adhesion being enhanced due to the inclusion of the felt-like material. Of course, a wide range of fastening arrangements could be employed, e.g., clips, clasps, snaps, pegs, sewing and the like. In another embodiment as shown in FIG. 7, position indicator assembly 45 can be integrated into the pair of shoes 2 during the manufacturing thereof. In this exemplary arrangement, first proximity switch element 70 and second proximity switch element 75 are located at inner instep section 18, while programmed chip 68 and battery 74 are located in tongue 21 and LED diodes 72 and 73 are located at toe section 17, with these various components being interconnected by electrical wires 117-120 which are routed within the material forming the respective shoe 5, 6.

Based on the above, it should be readily apparent that, in accordance with the present invention, the proximity switch elements need not directly engage each other and the overall indicator assembly can be located in various positions on the shoes, either as retrofit attachments or integrated into the shoes during the manufacturing thereof. In particular, it should be noted that, since the switch elements do not need to be in contact with one another for activation purposes, these elements can be located at a wide range of places on the shoes while still enabling the assembly to provide the requisite electrical connection. In addition, if only one indicator is employed on a single shoe, a single transmitter/receiver set can be utilized. In any case, although described with reference to preferred embodiments of the invention, it should be readily understood that various changes and/or modifications can be made to the invention without departing from the spirit thereof.

The invention claimed is:

1. A shoe pair with position indicator assembly to signal a proper alignment of a matched pair of shoes comprising:

first and second shoes; and a position indicator assembly including first and second positioning units attached to the first and second shoes respectively, with the first and second positioning units including at least one indicator mounted on at least one of the first and second shoes, at least one battery for powering the at least one indicator, and a proximity switch, electrically interposed between the at least one battery and the at least one indicator, including first and second proximity switch elements provided on the first and second shoes respectively, said proximity switch being configured to be activated for electrically connecting the at least one battery with the at least one indicator when the first and second proximity switch elements are arranged within a predetermined, spaced distance from each other wherein, when the matched pair of shoes are properly aligned and within the predetermined, space distance from each other, the at least one indicator will be automatically activated to indicate that the matched pair are properly aligned.

2. The shoe pair with position indicator assembly according to claim 1, wherein each of the shoes having a shoe body including a sole portion and an upper portion, said upper portion having at least a toe section, inner and outer instep sections and a counter section and wherein the first and second proximity switch elements are located at the inner instep portions of first and second shoes, respectively, such that the first and second proximity switch elements are still spaced from each other when the toe and counter sections of the first shoe are respectively abutting the toe and counter sections of the second shoe.

3. The shoe pair with position indicator assembly according to claim 2, wherein the inner instep sections of the first and second shoes are spaced from one another by a specified distance and the predetermined, spaced distance is equal to or greater than the specified distance.

4. The shoe pair with position indicator assembly according to claim 3, wherein the predetermined, spaced distance is approximately ½ inch.

5. The shoe pair with position indicator assembly according to claim 1, wherein the at least one indicator is a visual indicator.

6. The shoe pair with position indicator assembly according to claim 1, wherein each of said first and second positioning units is adhesively attached to a respective one of the first and second shoes.

7. The shoe pair with position indicator assembly according to claim 1, wherein the first and second positioning units are symmetrical and mirror images of one another.

8. The shoe pair with position indicator assembly according to claim 1, wherein the first and second proximity switch elements of the proximity switch are paired such that the proximity switch can only be activated upon pairing the first and second shoes.

9. The shoe pair with position indicator assembly according to claim 1, wherein the position indicator assembly further incorporates a timer limiting the electric connection of the at least one battery with the at least one indicator to only a preset time period following activation of the proximity switch.

10. The shoe pair with position indicator assembly according to claim 1, wherein the first and second positioning units are integrated into spaced portions of the body of a respective one of the first and second shoes.

11. A shoe pair with an indicator assembly comprising:

first and second shoes; and a position indicator assembly including first and second positioning units attached to the first and second shoes respectively, with the first and second positioning units including at least one indicator mounted on at least one of the first and second shoes, at least one battery for powering the at least one indicator, and a proximity switch including first and second proximity switch elements provided on the first and second shoes respectively, said proximity switch being configured to be activated for electrically activating the at least one indicator when the first and second proximity switch elements are arranged within a predetermined, spaced distance from each other wherein, when the pair of shoes are matched, properly arranged and within the predetermined, space distance from each other, the at least one indicator will be automatically activated to indicate proper placement of the first and second shoes.

12. The shoe pair with position indicator assembly according to claim 11, wherein the predetermined, spaced distance is approximately ½ inch.

13. The shoe pair with position indicator assembly according to claim 11, wherein the first and second proximity switch elements of the proximity switch are paired such that the proximity switch can only be activated upon pairing the first and second shoes.

14. The shoe pair with position indicator assembly according to claim 11, wherein the position indicator assembly further incorporates a timer limiting the electric connection of the at least one battery with the at least one indicator to only a preset time period following activation of the proximity switch.

15. The shoe pair with position indicator assembly according to claim 11, wherein the first and second positioning units are integrated into spaced portions of the body of a respective one of the first and second shoes.

16. A method of signaling a proper alignment of a matched pair of shoes comprising:

positioning first and second shoes, having first and second proximity switch elements mounted on the first and second shoes respectively, adjacent one another;

completing an electrical connection through the first and second proximity switch elements when the first and second shoes are within a predetermined, spaced distance from each other; and activating at least one indicator when the first and second shoes are a matched pair, with the electrical connection being completed thereby signaling a correct arrangement of the matched pair of shoes on feet of a wearer.

17. The method of claim 16, wherein positioning the first and second shoes constitutes putting the first and second shoes on feet of the wearer, and activating the at least one indicator constitutes providing a visual and/or audible indication to the wearer that the pair of shoes are on the correct feet.

18. The method of claim 16, wherein the electrical connection is completed with the first and second proximity switch elements are located at inner instep portions of the first and second shoes, respectively.

19. The method of claim 16, further comprising: limiting an activation of the at least one indicator to only a preset time period.

20. The method of claim 16, further comprising: entering a sleep mode when the first and second proximity switch elements are out of a specified range from each other.

* * * * *